US007891413B2

(12) United States Patent
Liu et al.

(10) Patent No.: US 7,891,413 B2
(45) Date of Patent: Feb. 22, 2011

(54) HEAT PIPE

(75) Inventors: Tay-Jian Liu, Tu-Cheng (TW); Chao-Nien Tung, Tu-Cheng (TW); Chuen-Shu Hou, Tu-Cheng (TW)

(73) Assignee: Foxconn Technology Co., Ltd., Tucheng, Taipei County (TW)

( * ) Notice: Subject to any disclaimer, the term of this patent is extended or adjusted under 35 U.S.C. 154(b) by 1113 days.

(21) Appl. No.: 11/309,560

(22) Filed: Aug. 22, 2006

(65) Prior Publication Data

US 2007/0295485 A1 Dec. 27, 2007

(30) Foreign Application Priority Data

Jun. 21, 2006 (CN) ..... 2006 1 0061240

(51) Int. Cl.
*F28D 15/00* (2006.01)

(52) U.S. Cl. ..... 165/104.26; 165/104.21; 29/890.032

(58) Field of Classification Search ..... 165/104.21, 165/104.26; 29/890.032
See application file for complete search history.

(56) References Cited

U.S. PATENT DOCUMENTS

| | | | | | |
|---|---|---|---|---|---|
| 3,587,725 | A * | 6/1971 | Basiulis | ..... | 165/104.26 |
| 3,734,173 | A * | 5/1973 | Moritz | ..... | 165/104.26 |
| 3,786,861 | A | 1/1974 | Eggers | | |
| 3,913,665 | A * | 10/1975 | Franklin et al. | ..... | 165/104.26 |
| 4,018,269 | A | 4/1977 | Honda et al. | | |
| 4,116,266 | A | 9/1978 | Sawata et al. | | |
| 4,351,388 | A * | 9/1982 | Calhoun et al. | ..... | 165/104.26 |
| 4,422,501 | A * | 12/1983 | Franklin et al. | ..... | 165/104.26 |
| 4,441,548 | A * | 4/1984 | Franklin et al. | ..... | 165/104.26 |
| 4,474,170 | A * | 10/1984 | McConnell et al. | ..... | 126/636 |
| 6,162,046 | A * | 12/2000 | Young et al. | ..... | 431/11 |
| 6,382,309 | B1 * | 5/2002 | Kroliczek et al. | ..... | 165/104.26 |
| 6,926,072 | B2 * | 8/2005 | Wert | ..... | 165/104.26 |
| 7,111,394 | B2 * | 9/2006 | Wert | ..... | 29/890.032 |
| 7,251,889 | B2 * | 8/2007 | Kroliczek et al. | ..... | 29/890.032 |
| 7,445,039 | B2 * | 11/2008 | Hou et al. | ..... | 165/104.26 |
| 2006/0086482 | A1 | 4/2006 | Thayer et al. | | |
| 2006/0157229 | A1 * | 7/2006 | Hong et al. | ..... | 165/104.26 |
| 2007/0107878 | A1 * | 5/2007 | Hou et al. | ..... | 165/104.26 |
| 2007/0114008 | A1 * | 5/2007 | Hou et al. | ..... | 165/104.26 |

FOREIGN PATENT DOCUMENTS

| | | | |
|---|---|---|---|
| CN | 92224358.1 | Y | 4/1993 |
| CN | 1183543 | A | 6/1998 |

* cited by examiner

*Primary Examiner*—Ljiljana (Lil) V Ciric
(74) *Attorney, Agent, or Firm*—Jeffrey T. Knapp

(57) ABSTRACT

A heat pipe includes a shell containing a working fluid therein, a capillary wick arranged within the shell and a vapor channel. The shell includes an evaporating section, a condensing section and an adiabatic section located between the evaporating section and the condensing section. The capillary wick includes a first segment occupying the whole of the evaporating section, a second segment and a third segment received in the condensing section and connected to the first segment by the second segment. The vapor channel is defined between the second segment of the capillary wick and the shell.

7 Claims, 8 Drawing Sheets

HEAT PIPE

FIELD OF THE INVENTION

The present invention relates generally to a heat transfer apparatus, and more particularly to a heat pipe.

DESCRIPTION OF RELATED ART

Heat pipes have excellent heat properties, and therefore are an effective means for heat transfer or dissipation from heat sources. Currently, heat pipes are widely used for removing heat from heat-generating components such as central processing units (CPUs) of computers. A heat pipe is generally a vacuum-sealed pipe. A wick structure is provided on an inner wall of the pipe, and the pipe contains at least a phase changeable working fluid employed to carry heat.

Generally, according to positions from which heat is input or output, the heat pipe has three sections: an evaporating section, a condensing section and an adiabatic section between the evaporating section and the condensing section. The adiabatic section is typically used for transport of the generated vapor from the evaporating section to the condensing section. When the evaporating section of a heat pipe is thermally attached to a heat-generating electronic component the working fluid receives heat from the electronic component and evaporates. The generated vapor then moves towards the condensing section of the heat pipe under the vapor pressure gradient between the two sections. In the condensing section, the vapor is condensed to liquid state by releasing its latent heat to, for example, a heat sink attached to the condensing section. Thus, the heat is removed away from the electronic component.

In the heat pipe, the evaporating section, the adiabatic section and the condensing section have different functions and constant efforts are being made to find ways of improving the heat transfer of the three sections.

Therefore, it is desirable is to provide a heat pipe which has a greater heat transfer capability.

SUMMARY OF THE INVENTION

A heat pipe in accordance with a preferred embodiment of the present invention comprises a shell containing a working fluid therein, a capillary wick arranged within the shell and a vapor channel. The shell comprises an evaporating section, a condensing section and an adiabatic section located between the evaporating section and the condensing section. The capillary wick comprises a first segment occupying the whole of the evaporating section, a second segment and a third segment received in the condensing section and connected to the first segment by the second segment. The vapor channel is defined between the second segment of the capillary wick and the shell. As the first segment of the capillary wick occupies the whole of the evaporating section the heat-absorption capability of the evaporating section is improved, thus accelerating evaporation of liquid contained in the evaporating section. Also as the first segment of the capillary wick occupies the whole of the evaporating section capillary force is increased, thus accelerating a flow of condensed fluid from the condensing section towards the evaporating section.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present heat pipe can be better understood with reference to the following drawings. The components in the drawings are not necessarily drawn to scale, the emphasis instead being placed upon clearly illustrating the principles of the present heat pipe. Moreover, in the drawings, like reference numerals designate corresponding parts throughout the several views.

DETAILED DESCRIPTION OF THE INVENTION

Figure 1:
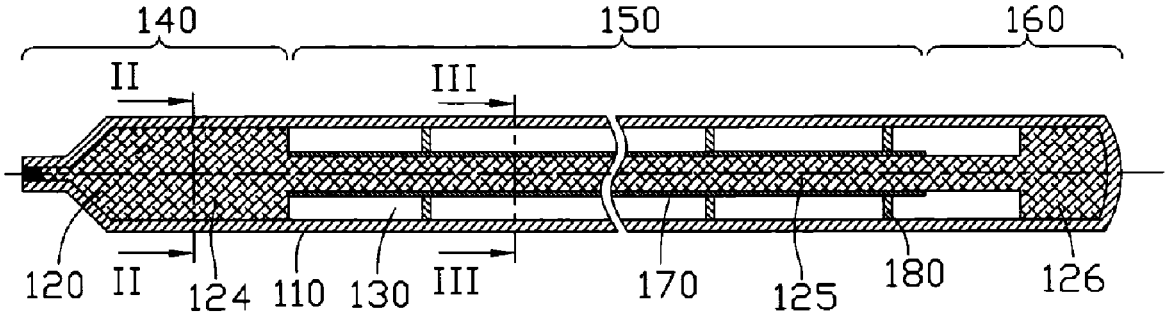
FIG. 1 is a longitudinal cross-sectional view of a heat pipe in accordance with a first embodiment of the present invention.
Figure 2:
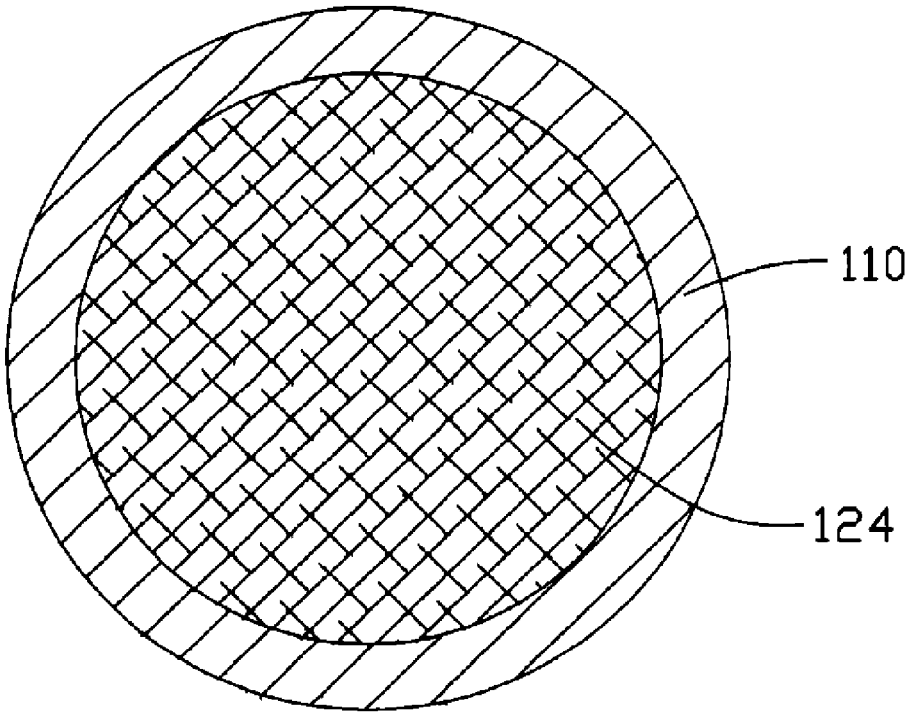
FIG. 2 is a radial cross-sectional view of the heat pipe of FIG. 1, taken along line II-II thereof.
Figure 3:
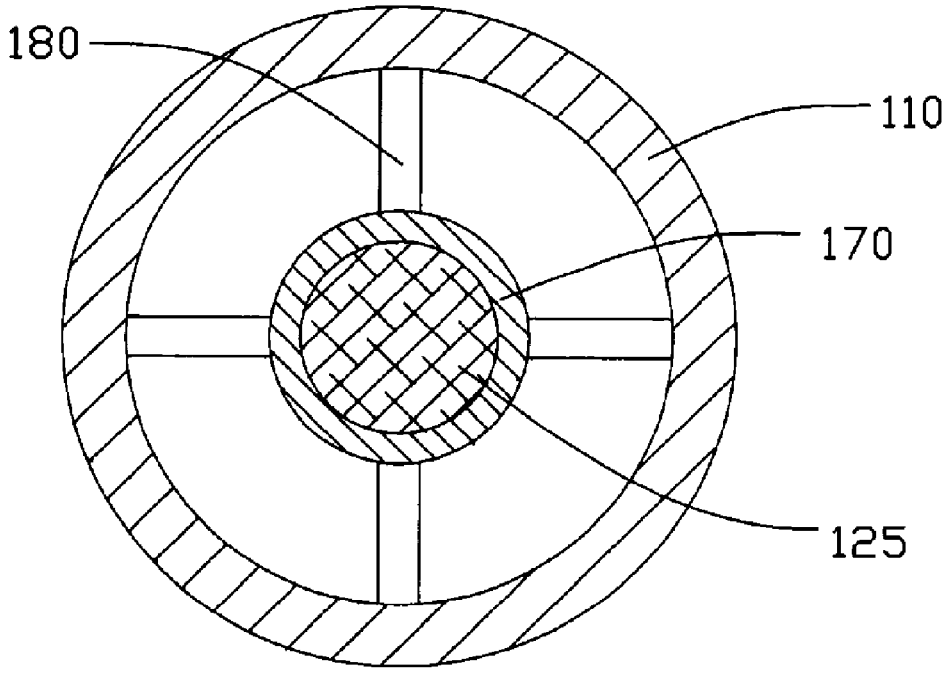
FIG. 3 is a radial cross-sectional view of the heat pipe of FIG. 1, taken along line III-III thereof.

FIGS. 1-3 show a heat pipe in accordance with a first embodiment of the present invention. The heat pipe comprises a metallic shell 110 having an inner surface (not labeled) which is smooth or defines micro-channels therein. The shell 110 is straight and tubular. A capillary wick 120 is provided within the shell 110. All other space in the shell 110 except the space occupied by the capillary wick 120 is used as a vapor channel 130. Working fluid (not shown) is contained in the shell 110, functioning as a heat carrier. According to positions from which heat is input or output, the heat pipe is defined with an evaporating section 140 at one end of the shell 110, a condensing section 160 at an opposite end of the shell 110, and an adiabatic section 150 located between the evaporating section 140 and the condensing section 160.

The capillary wick 120 comprises three segments 124, 125, 126. The first wick segment 124 is located within the evaporating section 140 and occupies the whole of the evaporating section 140. As the first wick segment 124 occupies the whole of the evaporating section 140, heat-absorption capability of the evaporating section 140 is improved, thus accelerating an evaporation of liquid contained in the evaporating section 140. Also as the first wick segment 124 occupies the whole of the evaporating section 140 it can increase capillary force thus accelerating flow of the condensed fluid from the condensing section 160 towards the evaporating section 140. The second wick segment 125 extends in an axial direction of the shell 110 from the first wick segment 124 to the third wick segment 126 to connect the first and third wick segments 124, 126. The second wick segment 125 is separate from the inner surface of the shell 110, and the vapor channel 130 is defined between the shell 110 and the second wick segment 125. The third wick segment 126 is located within the condensing section 160 and occupies a distal end portion (not labeled) of the condensing section 160 which is remote from the adiabatic section 150 of the heat pipe.

A partition 170 is employed between the shell 110 at the adiabatic section 150 and the second wick segment 125 and attached on an outer surface of the second wick segment 125. The partition 170 can be a metallic sheet or a metallic tube. Because of an arrangement of the partition 170 attached on the second wick segment 125 at the adiabatic section 150, in the adiabatic section 150 the vapor flows only along the vapor channel 130 toward the condensing section 160 and the liquid flows only through the second wick segment 125 towards the evaporating section 140. The vapor and the liquid in the adiabatic section 150 are separated by the partition 170, which can avoid adverse contact between the vapor and liquid. Thus, the condensed working fluid from the condensing section 160 can smoothly reach the evaporating section 140 and is prevented from being heated by the high temperature vapor at the adiabatic section 150. As a result, heat-absorption and heat-dissipation of the working fluid of the heat pipe is enhanced and heat-transfer efficiency of the heat pipe is accordingly improved.

Figure 4:
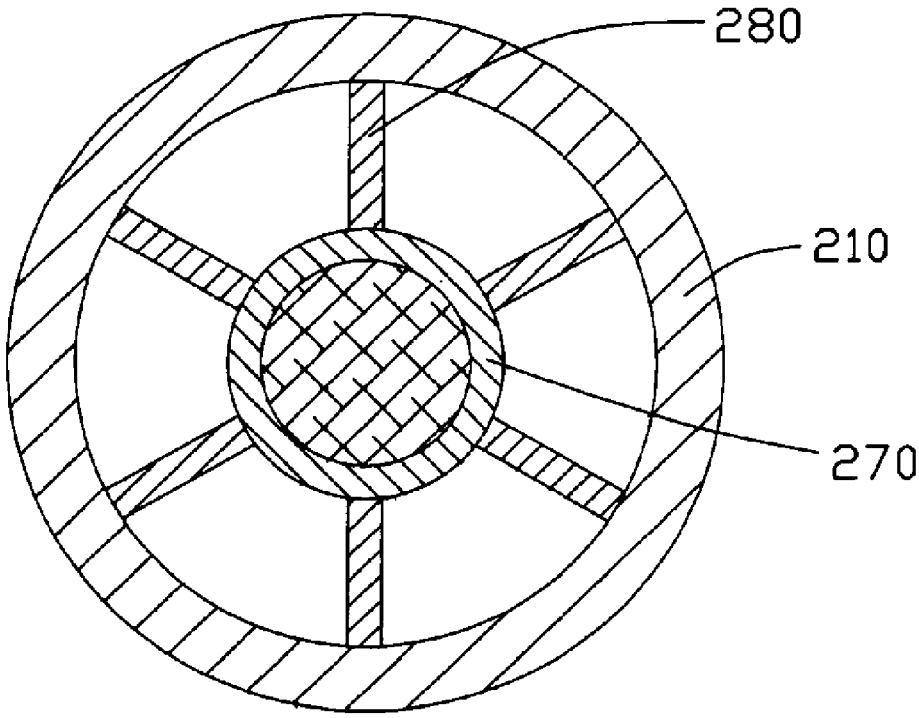
FIG. 4 is a radial cross-sectional view of a heat pipe in accordance with a second embodiment of the present invention.
Figure 5:
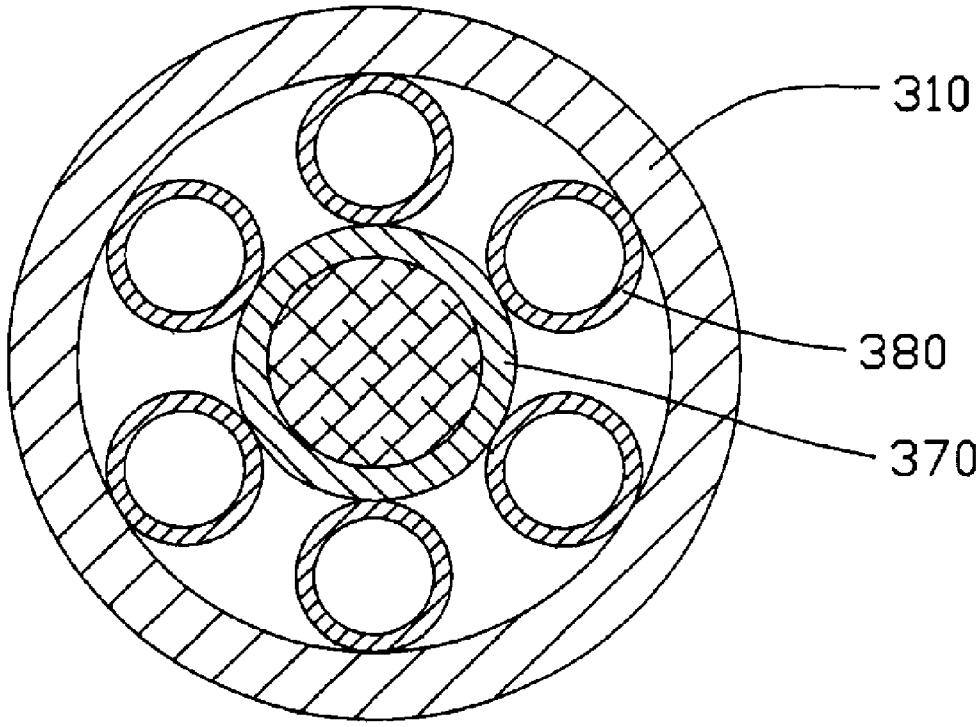
FIG. 5 is a radial cross-sectional view of a heat pipe in accordance with a third embodiment of the present invention.

A plurality of retainers 180 are provided between the shell 110 and the partition 170 to retain the partition 170 and the second wick segment 125 in a center of the shell 110. The retainers 180 are pillar-shaped in this embodiment. In a second embodiment as shown in FIG. 4, retainers 280 between a shell 210 and a partition 270 of a heat pipe are a plurality of ribs extending in a longitudinal direction of the heat pipe. In a third embodiment as shown in FIG. 5, retainers 380 between a shell 310 and a partition 370 of a heat pipe are a plurality of hollow tubes.

Figure 6:
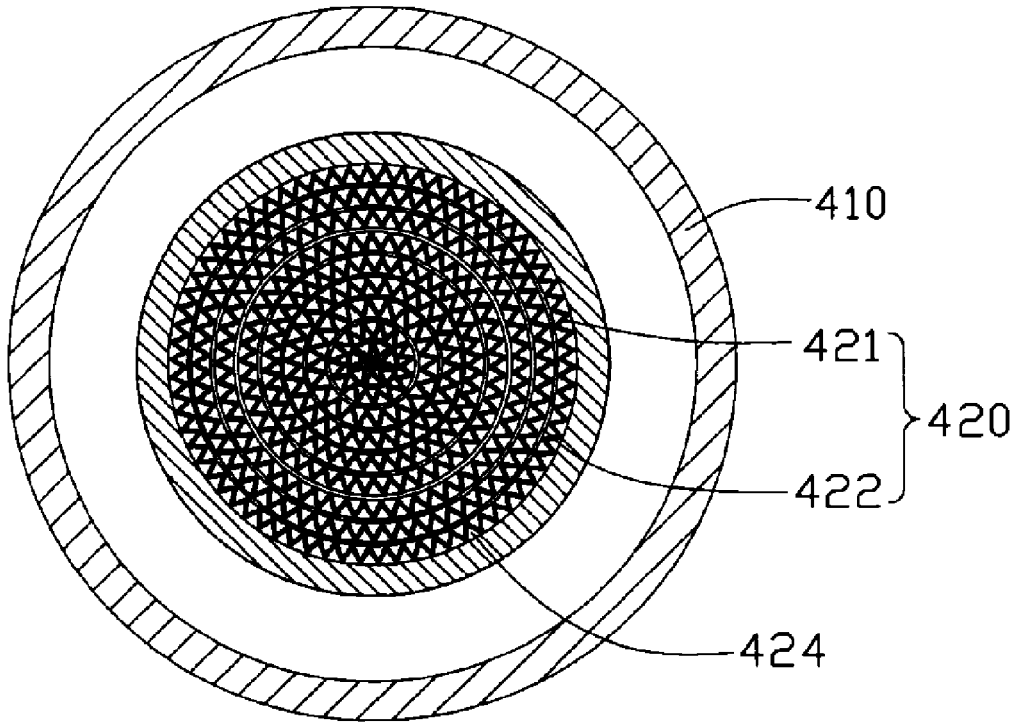
FIG. 6 is a radial cross-sectional view of a heat pipe in accordance with a fourth embodiment of the present invention.

FIG. 6 shows a heat pipe in accordance with a forth embodiment of the present invention. The heat pipe has beehive-type capillary wick 420. The capillary wick 420 comprises a plurality of wavy metal sheets 421 and a plurality of plate-type metal sheets 422. The sheets 421, 422 respectively are bent to be tube-shaped and coaxial with a shell 410 of the heat pipe when the capillary wick 420 is employed within the shell 410. The sheets 421, 422 are alternately arranged in a radial direction of the shell 410 of the heat pipe and define a plurality of channels 424 extending along an axial direction of the shell 410. This kind of capillary wick 420 makes it feasible for the pore rate and pore size to be efficiently controlled by changing the structure of the sheets 421, 422. In practice, the capillary wick may be a sintered-type wick, meshed-type wick, a beehive-type wick or any combination of these types.

Figure 7:
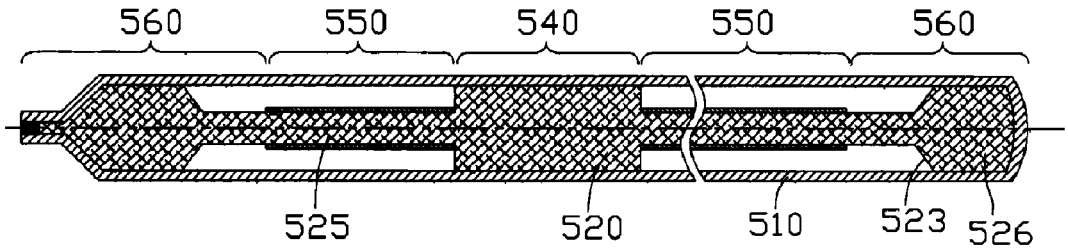
FIG. 7 is a longitudinal cross-sectional view of a heat pipe in accordance with a fifth embodiment of the present invention.

FIG. 7 shows a heat pipe in accordance with a fifth embodiment of the present invention. Different from the first embodiment of the present invention, the heat pipe comprises an evaporating section 540 located in a central portion of the shell 510 of the heat pipe, two condensing sections 560 located at two free end portions of the shell 510 of the heat pipe, and two adiabatic sections 550 located between corresponding condensing sections 560 and the evaporating section 540. Accordingly, the capillary wick 520 comprises two second wick segments 525 and two third wick segments 526. A slope 523 is defined at each third wick segment 526 of the capillary wick 520 to get a larger condensing area. Partitions (not labeled) sheathe the second wick segments 525, and vapor channels (not labeled) are defined between the shell 510 and the second wick segments 525.

Figure 8:
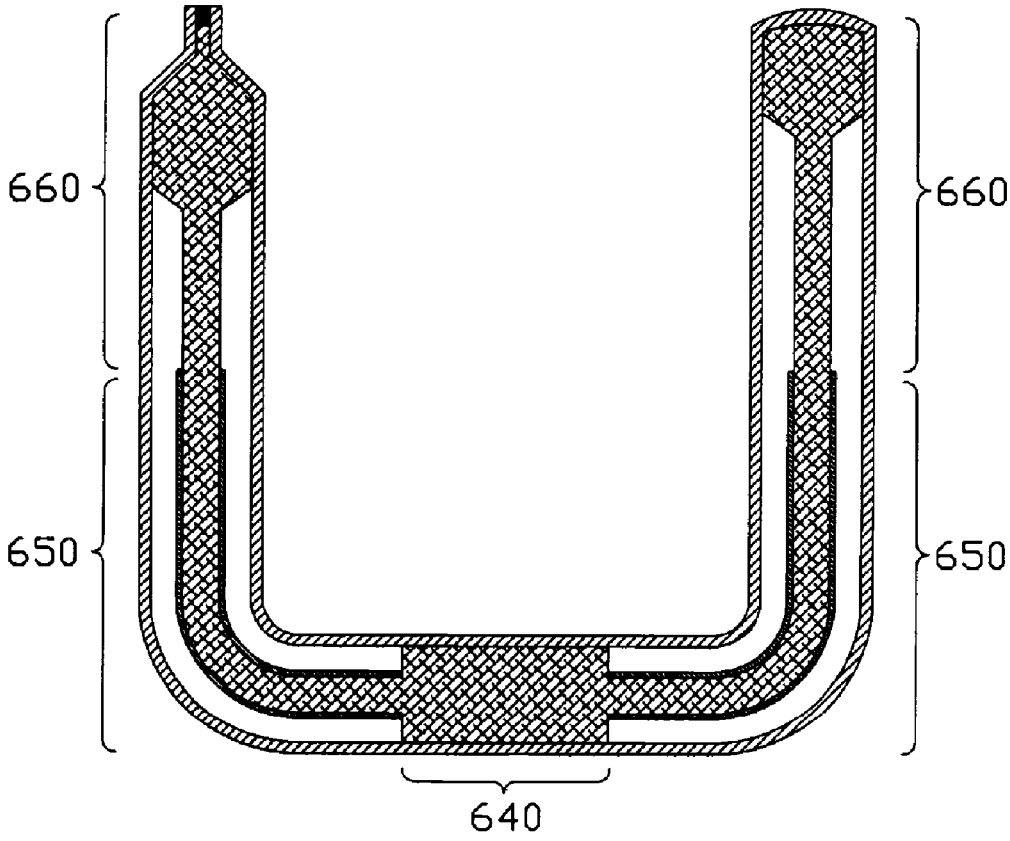
FIG. 8 is a longitudinal cross-sectional view of a heat pipe in accordance with a sixth embodiment of the present invention.

FIG. 8 shows a heat pipe in accordance with a sixth embodiment of the present invention. The heat pipe is U-shaped, and can be obtained by bending the heat pipe of the fifth embodiment of the present invention. The two condensing sections 660 are parallel to each other and perpendicular to the evaporating section 640. The heat pipe is bent at the adiabatic sections 650 thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention, for example, the shell of the heat pipe may be flattened, to the full extent indicated by the broad general meaning of the terms in which the appended claims are expressed.

What is claimed is:

1. A heat pipe comprising:

a shell containing a working fluid therein, the shell comprising an evaporating section, a condensing section and an adiabatic section located between the evaporating section and the condensing section;

a capillary wick arranged within the shell, the capillary wick comprising a first segment, a second segment and a third segment, the first segment fully filling a whole of the evaporating section, the third segment being received in the condensing section and being connected to the first segment by the second segment; and a vapor channel defined between the second segment of the capillary wick and the shell;

wherein a partition is employed between the shell at the adiabatic section and the second segment of the capillary wick, and is attached on an outer surface of the second segment of the capillary wick; and wherein a plurality of retainers are provided between the shell and the partition to retain the partition and the second segment of the capillary wick in a center of the shell.

2. The heat pipe of claim 1, wherein the condensing section is partially occupied by the third segment of the capillary wick.

3. The heat pipe of claim 1, wherein the second segment of the capillary wick is separated by a distance from an inner surface of the shell to thereby define the vapor channel in the shell.

4. The heat pipe of claim 1, wherein the retainers comprise a plurality of pillars.

5. The heat pipe of claim 1, wherein the evaporating section is located at an end of the shell, and the condensing section is located at an opposite end of the shell.

6. A heat pipe comprising:

a tubular metal shell having an evaporating section for receiving heat, a condensing section for releasing the heat and an adiabatic section between the evaporating section and the condensing section;

a capillary wick received in the metal shell, having a first segment completely filling a whole of the evaporating section, a second segment, and a third segment received in the condensing section and connecting with the first segment via the second segment; and a vapor channel being defined in the metal shell, between the metal shell and the second segment of the capillary wick;

wherein a partition sheathes an outer surface of the second segment of the capillary wick and a plurality of retainers are provided between the metal shell and the partition to retain the partition and the second segment of the capillary wick in position.

7. The heat pipe of claim 1, wherein the third segment of the capillary wick fully fills a distal end portion of the condensing section which is remote from the adiabatic section of the heat pipe.

* * * * *